US010472031B2

(12) United States Patent
Pascale et al.

(10) Patent No.: US 10,472,031 B2
(45) Date of Patent: Nov. 12, 2019

(54) PERSONAL FLOTATION DEVICE

(71) Applicants: Jason A. Pascale, Bloomsbury, NJ (US); Melissa Siladji, Voorhees, NJ (US)

(72) Inventors: Jack H. Pascale, Greentown, PA (US); Melissa Siladji, Voorhees, NJ (US)

(73) Assignees: Jason A. Pascale, Bloomsbury, NJ (US); David J. Pascale, Lexington, NC (US)

( * ) Notice: Subject to any disclaimer, the term of this patent is extended or adjusted under 35 U.S.C. 154(b) by 0 days.

(21) Appl. No.: 16/116,268

(22) Filed: Aug. 29, 2018

(65) Prior Publication Data

US 2019/0061888 A1 Feb. 28, 2019

Related U.S. Application Data

(60) Provisional application No. 62/551,364, filed on Aug. 29, 2017.

(51) Int. Cl.
*B63C 9/115* (2006.01)

(52) U.S. Cl.
CPC ..... *B63C 9/115* (2013.01)

(58) Field of Classification Search
CPC ..... B63C 9/115; B63C 9/093
See application file for complete search history.

(56) References Cited

U.S. PATENT DOCUMENTS 2,521,205 A 9/1950 Mahlam
4,052,762 A 10/1977 Zawislak
(Continued)

FOREIGN PATENT DOCUMENTS

WO 2004007275 A2 1/2004
WO 2005095203 A1 10/2005
WO 2014177731 A1 11/2014

OTHER PUBLICATIONS http://www.menacemarine.com.au/hercules-sports-life-jacket-junior-2; (2014).

(Continued)

*Primary Examiner* — S. Joseph Morano
*Assistant Examiner* — Jovon E Hayes
(74) *Attorney, Agent, or Firm* — Kim IP Law Group PLLC

(57) ABSTRACT

A personal flotation device is disclosed. The personal flotation device comprises a wearable shell comprising an articulated section extending across a width of the wearable shell, a first buoyant member housed by the wearable shell, a second buoyant member housed by the wearable she and spaced from the first buoyant member, wherein the articulated section extends between the first and second buoyant members and defines a substantially planar vertical extent therebetween, and a fastening assembly configured to fasten the wearable shell to a user's torso at one of a plurality of positions along the substantially planar vertical extent of the articulated section and/or along a passageway inside the wearable shell and adjacent to the articulated section, wherein the fastening assembly includes a fastener movable between a first position defining a first circumferential length and a second position defining a second circumferential length. The personal flotation device is thus configured to mitigate or prevent it from rising up along a user's body when the personal flotation device is submerged in water and secured to the user.

17 Claims, 7 Drawing Sheets

(56) References Cited

U.S. PATENT DOCUMENTS

| | | | | |
|---|---|---|---|---|
| 4,498,882 | A * | 2/1985 | Evert | B63C 9/1255 441/107 |
| 5,184,968 | A | 2/1993 | Michalochick et al. | |
| 5,295,765 | A | 3/1994 | Choi | |
| 5,378,084 | A | 1/1995 | Walters et al. | |
| 5,451,121 | A * | 9/1995 | Seligman | B63C 11/04 405/186 |
| 5,459,874 | A | 10/1995 | Meredith | |
| 5,953,750 | A * | 9/1999 | Stella | B63C 9/1255 2/2.15 |
| 6,089,936 | A * | 7/2000 | Hoffman | B63C 9/115 441/117 |
| 6,112,327 | A | 9/2000 | Shaffer | |
| 6,463,593 | B2 | 10/2002 | Cotten | |
| 6,478,510 | B1 * | 11/2002 | Young | B63C 11/08 405/186 |
| 7,255,621 | B2 | 8/2007 | Deslauriers | |
| 7,438,619 | B2 * | 10/2008 | Staver | A41D 7/001 441/115 |
| 7,540,690 | B2 * | 6/2009 | Garcia | B63C 11/08 405/185 |
| 8,262,426 | B1 | 9/2012 | Barbis | |
| 9,139,271 | B2 | 9/2015 | Beach-Drummond | |
| 2004/0029466 | A1 | 2/2004 | Kloessing | |
| 2011/0004968 | A1 | 1/2011 | Morgan | |
| 2014/0134903 | A1 * | 5/2014 | Collins | A62B 35/0025 441/106 |
| 2017/0006932 | A1 | 1/2017 | Quaglia | |
| 2019/0061888 | A1 * | 2/2019 | Pascale | B63C 9/115 |

OTHER PUBLICATIONS http://www.att-tactical.com/att_ballistics_maritime_ballistic_maritime_ballistic_vest.html; (2017).

https://www.aliexpress.com/item/Professional-Foam-Life-Jacket-Adult-Safety-Life-Vest-Swimming-Vest-With-Whistle-Drift-Suit-Water-Safety/1204593119.html; (2017).

https://trainers4me.com/Swimwear-%26-Safety-Vest-Rescue/; (2017).

* cited by examiner

PERSONAL FLOTATION DEVICE

FIELD OF THE INVENTION

The present disclosure relates generally to personal flotation devices.

BACKGROUND OF THE INVENTION

Personal flotation devices (also commonly referred to as life jackets or life vests) come in many types and styles and are used in many applications Examples of such types and styles include, but are not limited to, inflatable vests, foam vests, hybrid vests, and the "Vest-type flotation aid" used in many recreational sports, as well as other vests for specific applications. However, personal flotation devices currently available on the market undergo a phenomenon known as "ride up" when worn by a user in water. This "ride up" phenomenon occurs as a result of the design of these personal flotation devices, which have a uniform profile from top to bottom on the inside of the device and rigid sides and, thus, cannot be tightened sufficiently enough to keep the device in place. Once the user wearing such a device enters the water, the device "rides up" until it hits the wearer under their armpits, chin, or ears, depending on the design of the device. This is not only uncomfortable and awkward for the user, but can actually cause pain and injury to the user when they repeatedly enter and leave the water, since the device can rub the area under the user's armpits, causing chafing.

The personal flotation device according to the present invention mitigates eliminates this "ride up" problem via inclusion of a fastener configured to secure the personal flotation device to the user's body and consequently minimize motion of the personal flotation device upwards along a user's body when submerged under water.

EMBODIMENTS OF THE INVENTION

One embodiment according to the present invention is a personal flotation device comprising a wearable shell comprising an articulated section extending across a width of the wearable shell, a first buoyant member housed by the wearable shell, a second buoyant member housed by the wearable shell and spaced from the first buoyant member, wherein the articulated section extends between the first and second buoyant members and defines a substantially planar vertical extent therebetween, and a fastening assembly configured to fasten the wearable shell to a user's torso at one of a plurality of positions along the substantially planar vertical extent of the articulated section, wherein the fastening assembly includes a fastener movable between a first position defining a first circumferential length and a second position defining a second circumferential length.

In certain embodiments, the fastening assembly of the personal flotation device according to the present invention comprises a single fastener selectively positionable along the substantially planar vertical extent of the articulated section. In certain embodiments, the fastening assembly of the personal flotation device according to the present invention comprises a plurality of fasteners extending along the substantially planar vertical extent of the articulated section.

In certain embodiments, the personal flotation device according to the present invention further comprises a plurality of hoops positioned along the substantially planar vertical extent of the articulated section, wherein each of the plurality of hoops are configured to receive the fastener for positioning the fastener at one of the plurality of positions along the substantially planar vertical extent of the articulated section. In certain embodiments, the personal flotation device according to the present invention further comprises a third buoyant member housed by the wearable shell and spaced from the first and second buoyant members, and a second fastener extending across a width of the wearable shell and positioned between the third buoyant member and one of the first or second buoyant members.

In certain embodiments, the fastener of the personal flotation device according to the present invention is an elongated fastener having a first end and a second end connectable to the first end.

In certain embodiments, the articulated section of the personal flotation device according to the present invention is configurable to have a thickness less than a thickness of one of the first or second buoyant members. In certain embodiments, the articulated section of the personal flotation device according to the present invention is a compressible section. In certain embodiments, the articulated section of the personal flotation device according to the present invention completely circumscribes the wearable shell.

In certain embodiments, the wearable shell of the personal flotation device according to the present invention further comprises a passageway therein adjacent to the articulated section and is configured to receive the fastening assembly.

Another embodiment according to the present invention is a personal flotation device comprising a wearable shell comprising an articulated section extending across a width of the wearable shell, a passageway inside the wearable shell and adjacent to the articulated section, a first buoyant assembly connected to the wearable shell, a second buoyant assembly connected to the wearable shell and spaced from the first buoyant assembly, wherein the articulated section extends between the first and second buoyant assemblies and defines a substantially planar vertical extent of the articulated section therebetween, a fastener extending along the passageway and selectively positionable along the substantially planar vertical extent of the articulated section, wherein the fastener is movable between a first position defining a first circumferential distance and a second position defining a second circumferential distance.

In certain embodiments, the first and second buoyant assemblies of the personal flotation device according to the present invention each define a circumferential distance around the wearable shell greater than one of the first or second circumferential distances defined by the fastener.

BRIEF DESCRIPTION OF THE DRAWINGS

The foregoing, as well as the following detailed description of the present invention, will be better understood when read in conjunction with the appended drawings. Certain embodiments are shown in the drawings for the purpose of illustrating the present invention. However, it should be understood that the present invention is not limited to the precise arrangements and instrumentalities shown.

In the drawings.

DETAILED DESCRIPTION OF THE INVENTION

Figure 1:
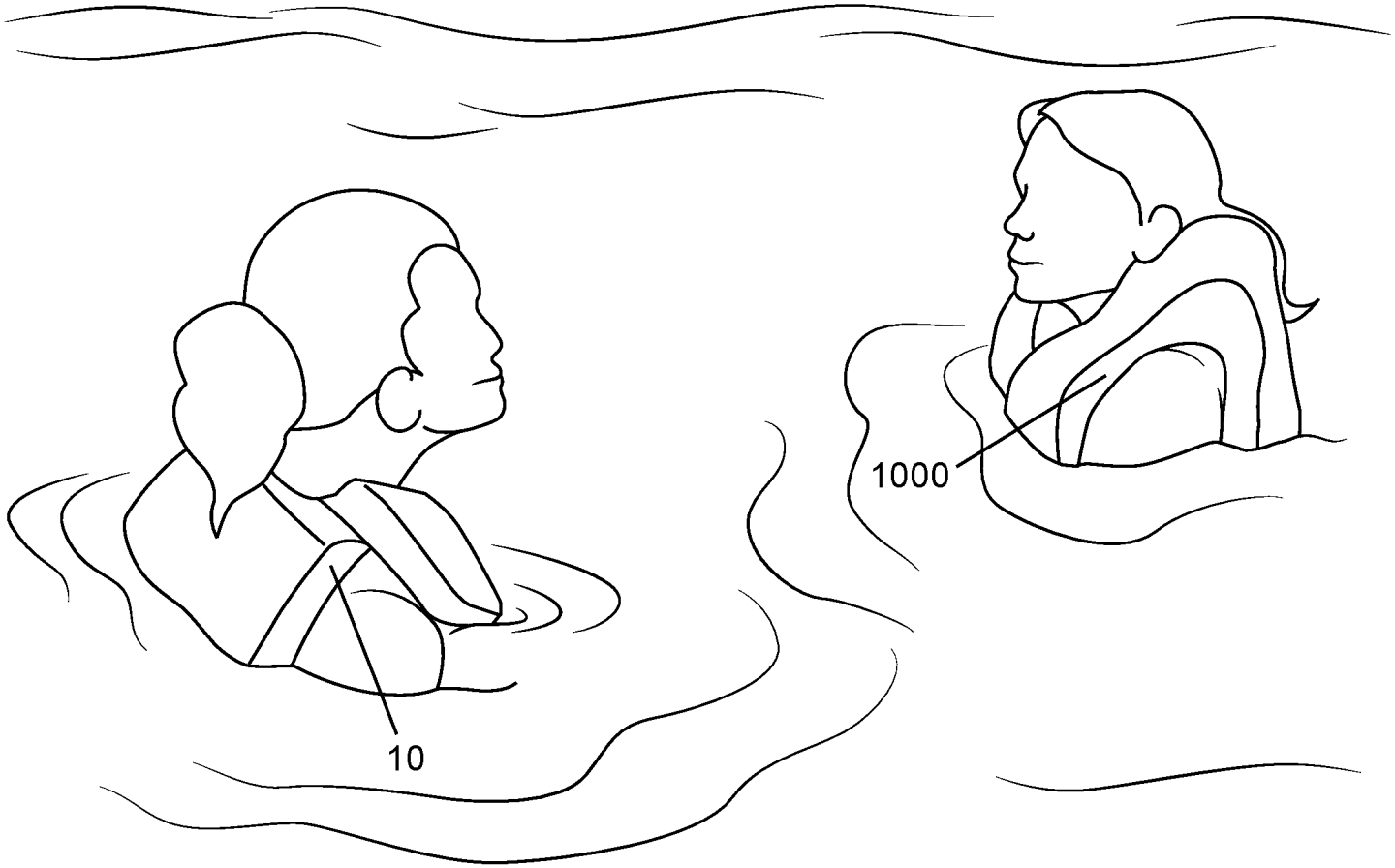
FIG. 1 is a partial perspective view of a personal flotation device in accordance with embodiments of the present invention as worn by a user alongside a conventional personal flotation device as worn by a user.

Reference will now be made in detail to the various embodiments illustrated the accompanying drawings. Wherever possible, the same or like reference numbers will be used throughout the drawings to refer to the same or like features. It should be noted that the drawings are in simplified form and are not drawn to precise scale.

Certain terminology may be used in the following description for convenience only and is not limiting. Directional terms such as top, bottom, left, right, above, below, front, real, and diagonal, may be used with respect to the accompanying drawings. The terms "right," "left," "front," and "rear" may be used to describe positions relative to an operator. The term "distal" shall mean away from the center of a body. The term "proximal" shall mean closer towards the center of a body and/or away from the "distal" end. The words "inwardly" and "outwardly" refer to directions toward and away from, respectively, the geometric center of an identified element and designated parts thereof. Such directional terms used in conjunction with the following description of the drawings should not be construed to limit the scope of the present invention in any manner not explicitly set forth. Additionally, the term "a," as used in the present specification, means "at least one." The terminology includes the words above specifically mentioned, derivatives thereof, and words of similar import.

"About" as used herein when referring to a measurable value, such as an amount, a temporal duration, and the like, is meant to encompass variations of ±20%, ±10%, ±5%, ±1%, or ±10.1% from the specified value, as such variations are appropriate.

Throughout this disclosure, various aspects of embodiments can be presented in a range format. It should be understood that the description in range format is merely for convenience and brevity and should not be construed as an inflexible limitation on the scope of the present invention. Accordingly, the description of a range should be considered to have specifically disclosed all the possible subranges, as well as individual numerical values within that range. For example, description of a range, such as from 1 to 6, should be considered to have specifically disclosed subranges, such as from 1 to 3, from 1 to 4, from 1 to 5, from 2 to 4, from 2 to 6, from 3 to 6, etc., as well as individual numbers within that range, for example, 1, 2, 2.7, 3, 4, 5, 5.3. and 6. This applies regardless of the breadth of the range.

Furthermore, the described features, advantages, and characteristics of the embodiments of the present invention disclosed herein may be combined in any suitable manner in one or more further embodiments of the present invention. One skilled in the relevant art will recognize, in light of the description herein, that the present invention can be practiced without one or more of the specific features or advantages of a particular embodiment. In other instances, additional features and advantages may be recognized in certain embodiments that may not be present in all embodiments.

Referring now to FIGS. 1-11B, a plurality of embodiment of a personal flotation device according to the present invention are disclosed.

As shown on the left of FIG. 1, an embodiment of the personal flotation dev according to the present invention as worn by a user exhibits minimal or no "ride up" on the user. As can be seen, the distance between personal flotation device 10 and the user's ears is substantial. By comparison, as shown on the left of FIG. 1, a conventional personal flotation device exhibits substantial "ride up" on the user. As can be seen, the distance between the personal flotation device 1000 and the user's ears is minimal to non-existent.

It is to be appreciated that, while the invention is intended primarily for the "vest-type" personal flotation devices, it can also be used in other styles.

Figure 2:
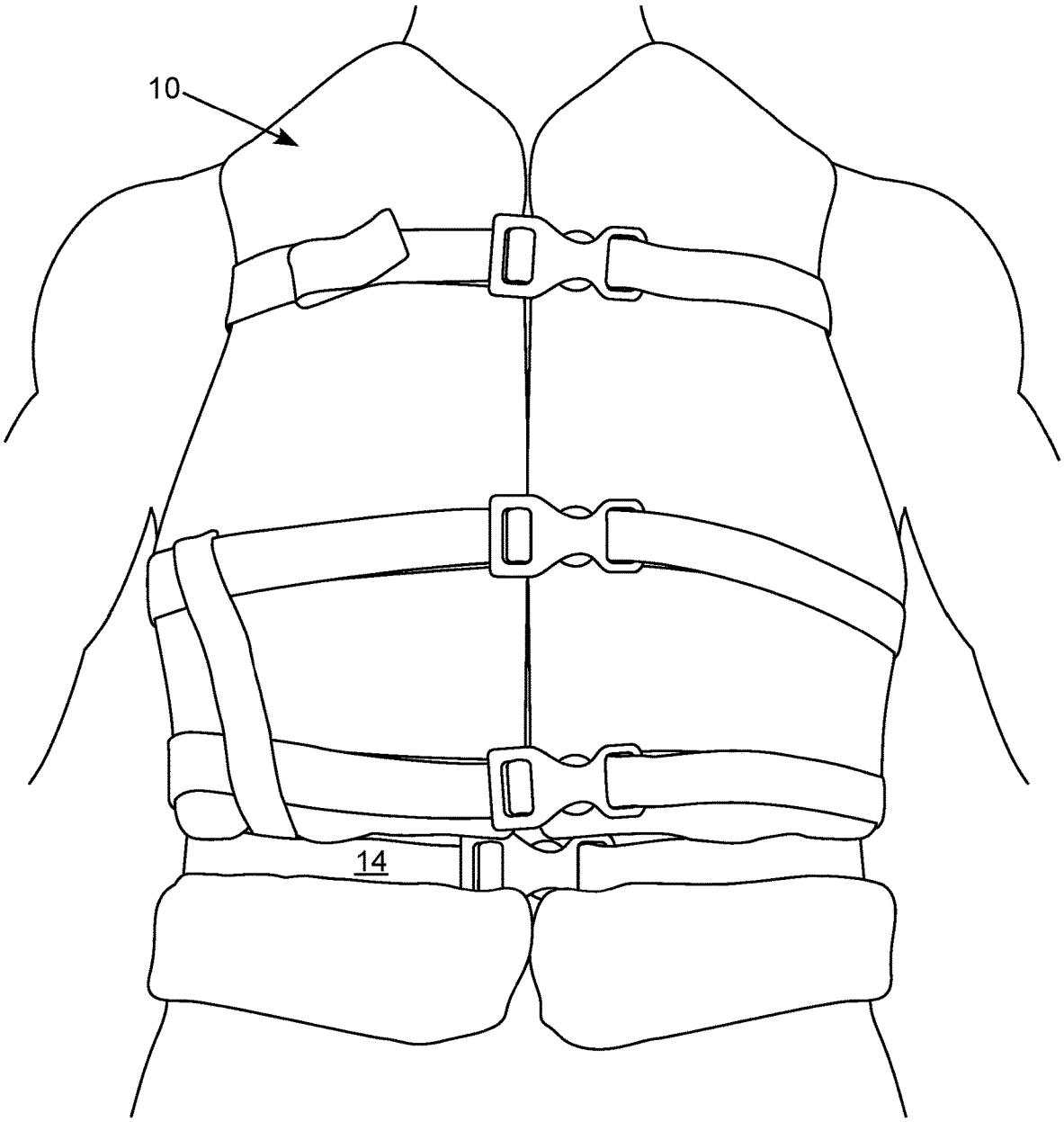
FIG. 2 is a front view of a personal flotation device in accordance with embodiments of the present invention as worn by a user
Figure 3:
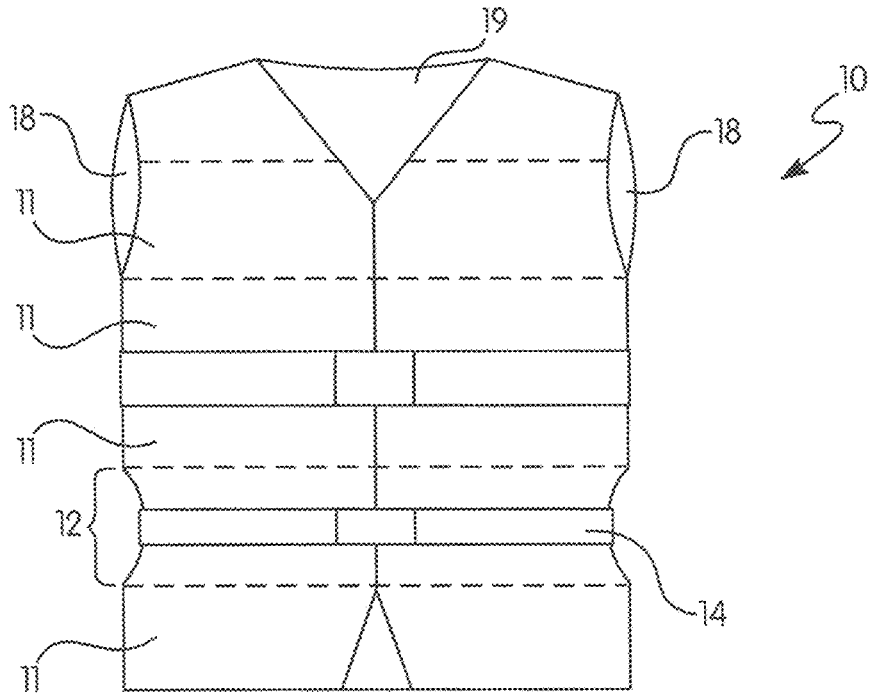
FIG. 3 is a front view of a personal flotation device in accordance with embodiments of the present invention.

Embodiments of the personal flotation device in accordance with the present invention are shown in FIGS. 2 and 3. In these embodiments, the personal flotation device 10 has a flexible or articulated section 12 roughly in the area of the waistline, flotation padding 16, life vest fastener 17, arm holes 18, and neck hole 19. This flexible or articulated section 12 is configured to accommodate a fastener 14, e.g., a strap or belt. Flexible or articulated section 12 may be a portion of personal flotation device 10 having less flotation padding 16 than the remainder of personal flotation device 10 or may have lithe to no flotation padding 16 and may instead be an indented area on personal flotation device 10. Consequently, flexible or articulated section 12 can be tightened more than the remainder of personal flotation device 10 around a user's waist. Thus, when a user wearing personal flotation device 10 is submerged in water, fastener 14 will affix personal flotation device 10 more securely to the user and minimize or eliminate "ride up." Furthermore, fastener 14 will also contact the lower ends of flexible or articulated section 12 as personal flotation device 10 is buoyed upwards, thereby preventing additional movement. It is to be appreciated that fastener 14 can take any form, such as, e.g., clasps, rope, ties, hook and loop fasteners, and so forth. Fastener 14 can also be configured to automatically further constrict around a user's waist when submerged under wager, e.g., by being fabricated from a hydrogel.

Figure 4:
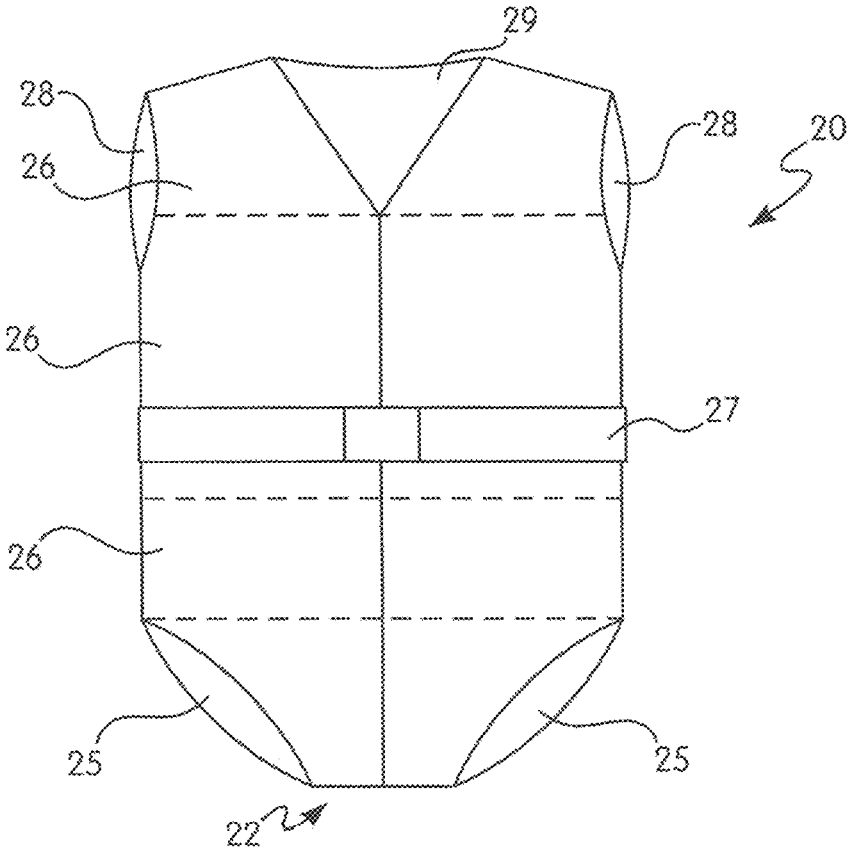
FIG. 4 is a front view of a personal flotation device in accordance with embodiments of the present invention.

Another embodiment of the personal flotation device in accordance with the present invention is shown in FIG. 4, wherein personal flotation device 20 comprises crotch fastener 22 in addition to leg holes 25, flotation padding 26, life vest fastener 27, arm holes 28, and neck hole 29. Crotch fastener 22 comprises a narrow strip fabricated from personal flotation device inner and cuter material (or some other material) and is attached to the bottom of the back panel of personal flotation device 20. Crotch fastener 22 is run between the user's legs and attached to the front panel of personal flotation device 20 via one or more snaps, buckles, clips, S hooks, or other attachment device(s). When crotch fastener 22 is attached, personal flotation device 20 would have a profile similar to a bathing suit for females. Crotch fastener 22 can be fabricated from a soft and stretchable material to prevent harm to the user if and when "ride up" is experienced. Examples of such materials include, but are not limited to, nylon.

Figure 5A:
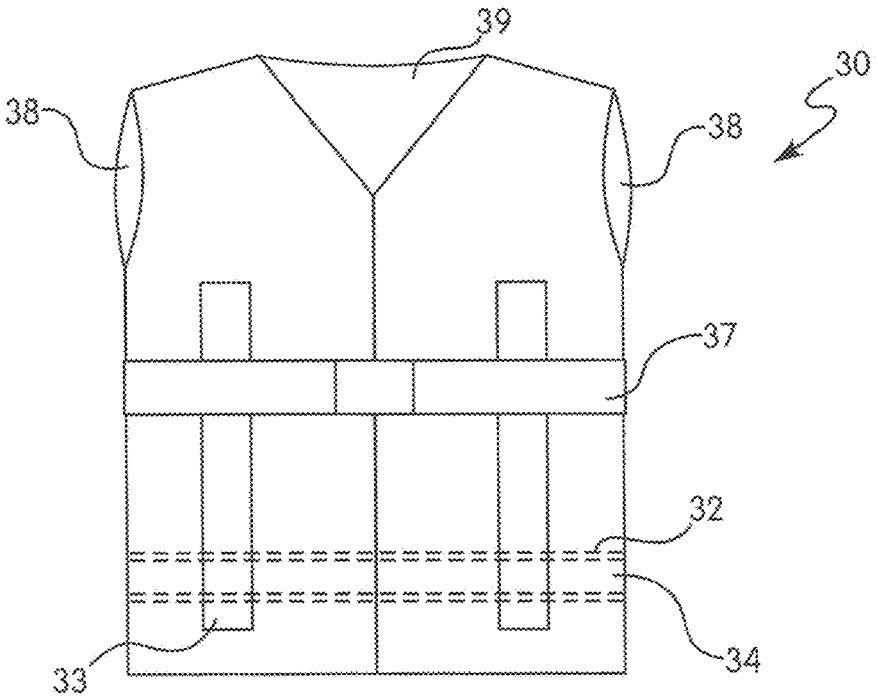
FIG. 5A is a front view of a personal flotation device accordance with embodiments of the present invention.
Figure 5B:
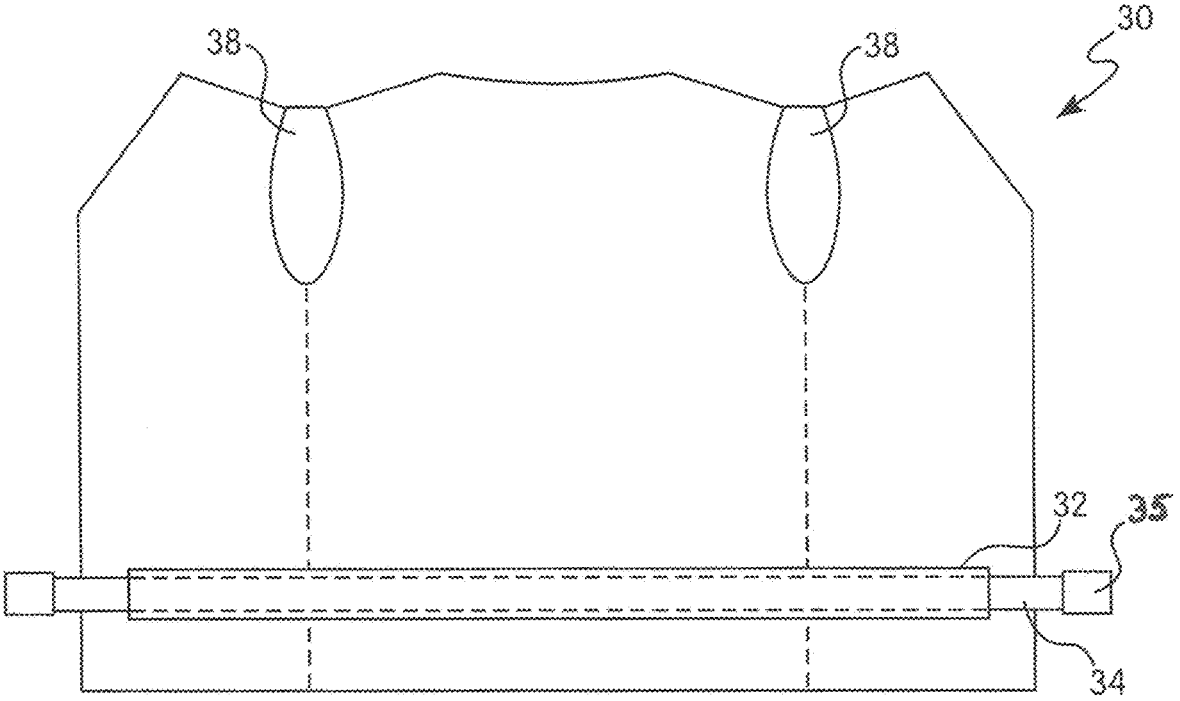
FIG. 5B is an expanded rear view of a personal flotation device in accordance with embodiments of the present invention.
Figure 6:
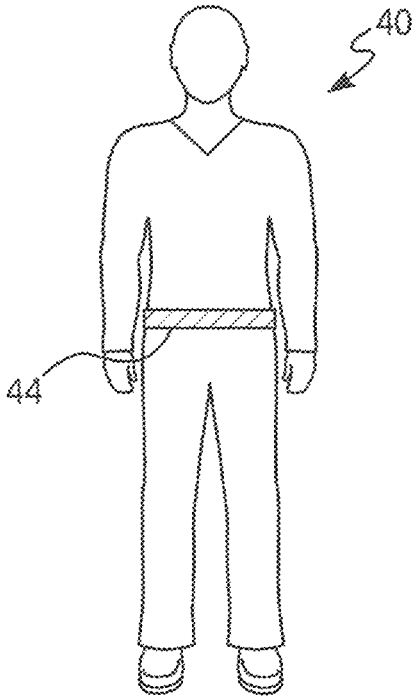
FIG. 6 is a front view of a personal flotation device in accordance with embodiments of the present invention as worn by a user.
Figure 7:
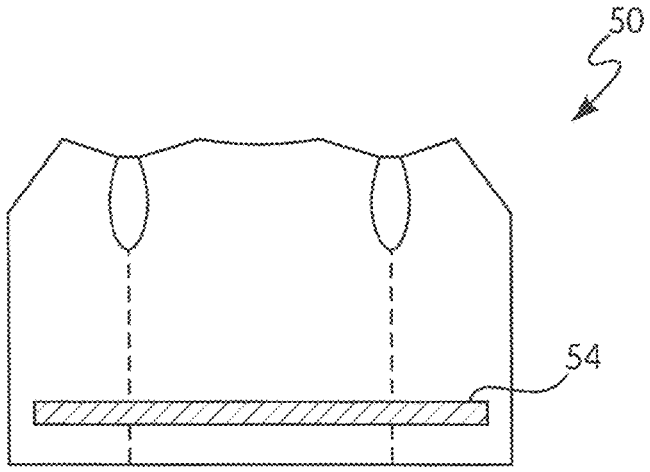
FIG. 7 is an expanded back view of a personal flotation device in accordance with embodiments of the present invention.
Figure 8:
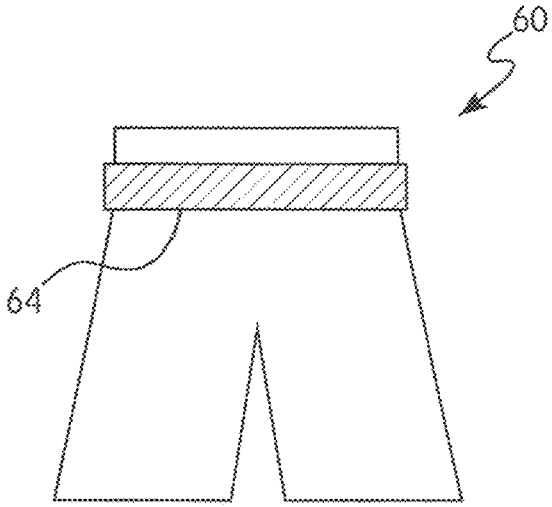
FIG. 8 is a front view of a personal flotation device in accordance with embodiments of the present invention.
Figure 9:
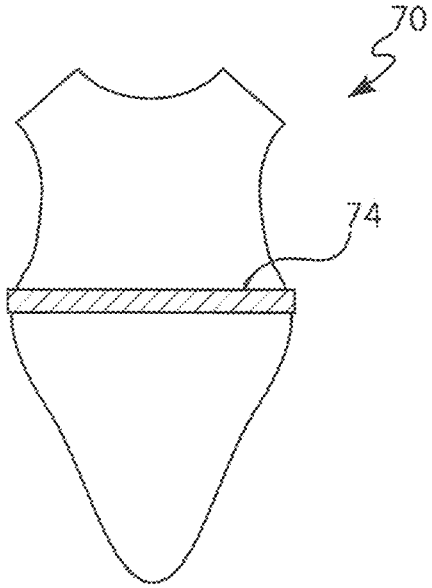
FIG. 9 is a front view of a personal flotation device in accordance with embodiments of the present invention.

Another embodiment of the personal flotation device in accordance with the present invention is shown in FIGS. 5A and 5B, wherein personal flotation device 30 comprises a different fastener 34 in addition to life vest fastener 37, arm holes 38, and neck hole 39. Personal flotation device 30 includes a fastener 34, such as a strap or belt, and an inner channel/passage 32 that runs along the inner side of personal flotation device 30. In other words, personal flotation device 30 includes a second fastener 34 that attaches to the back of the device and runs along the inside of'the device through inner channel/passage 32 to the front of the device. The material from which inner channel/passage 32 is fabricated is preferably a heavy duty elastic to absorb shock or other strong fabric and has a reinforcing panel on the other side of the device's interior material fabricated from a material such as nylon. In certain embodiments, inner channel/passage 32 is fabricated from nylon. The reinforcing panel can be sewn along its edges as well as in the field to provide extra strength. It is to be appreciated that fastener 34 can optionally run along the inner side of personal flotation device 30 to the front of the device, then pass through reinforced eyelets so the user can tighten fastener 34. Personal flotation device 30 may also comprise one or more inner belt access pockets 33 extending from the outer side to the inner side of the device for tightening, loosening, and/or releasing fastener 34. It is also to be appreciated that fastener 34 may further comprise a material wrapped around the portions thereof where the ends of fastener 34 connect (connector 35) for the purpose reducing or avoiding discomfort and injury, e.g., chafing, to the user. Such materials include, but are not limited to, padding.

Further embodiments of the, personal flotation device in accordance with the present invention are shown in FIGS. 6-9, personal flotation devices 40, 50, 60, and 70 comprise independent fasteners 44, 54, 64, and 74, respectively. These personal flotation devices can include an article of clothing, e.g., a belt (FIG. 6) or a swim suit (FIGS. 8 and 9), that includes a fastener, or even an independent fastener by itself, having a connecting mechanism. The connecting mechanism may be configured to attach to a personal flotation device that has, on an inner surface, a corresponding fastener, e.g., a hook and loop fastener. For example, personal flotation devices 40, 50, 60, and 70 may be attached to independent fasteners 44, 54, 64, and 74, respectively, via snaps, buckles, clips, hooks, or other fasteners known in the art. The independent fastener can be attached to the personal flotation device on the back panel. In another embodiment, the independent fastener may be incorporated as an integral part of a male or female bathing suit, the waistline area having attachment features, e.g., attached loops, as would be used to secure a belt.

Figure 10A:
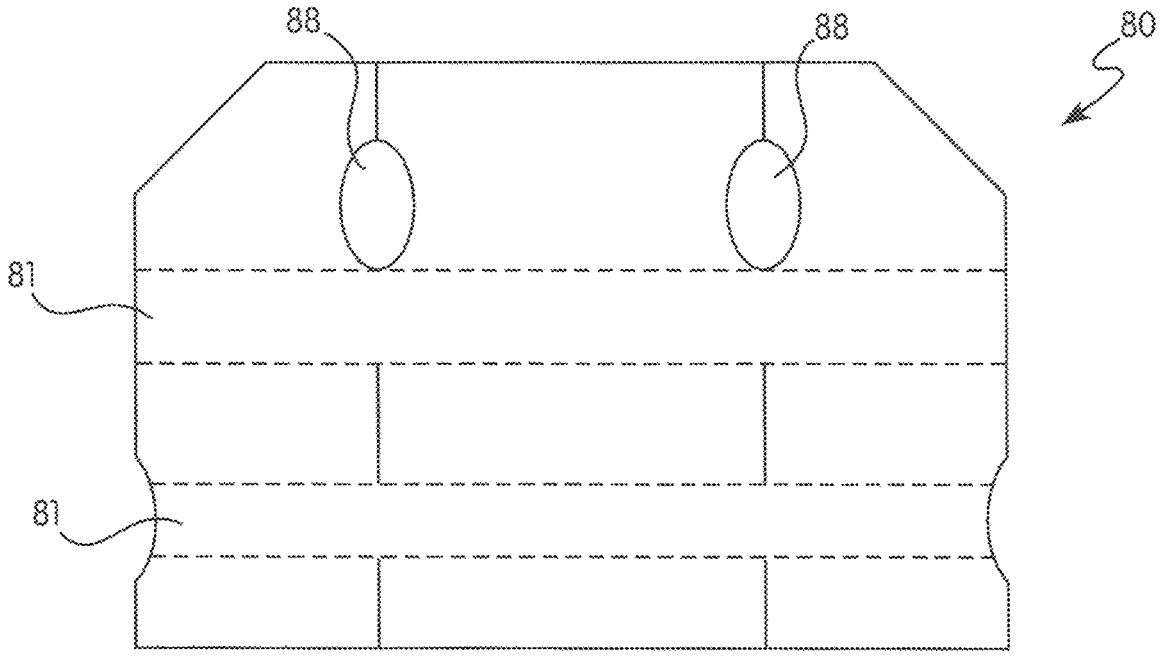
FIG. 10A is an expanded back view of a personal flotation device in accordance with embodiments of the present invention.
Figure 10B:
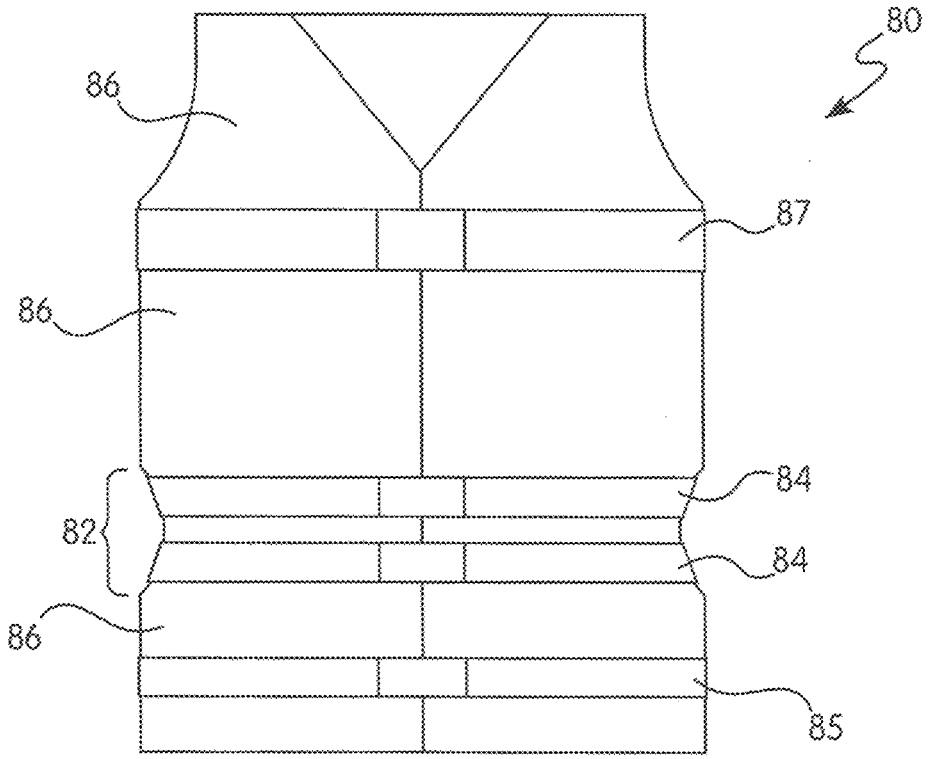
FIG. 10B is a front view of a personal flotation device in accordance with embodiments of the present invention.

Another embodiment of the personal flotation device in accordance with the present invention is shown in FIGS. 10A and 10B, wherein personal flotation device 80, in addition to life vest fasteners 85 and 87, flotation padding 86, arm holes 88, and neck hole 89, comprises interior channels 81 located on the inner side of personal flotation device 80 that are configured to accommodate inner fasteners that are secured around the user when device 80 is worn. These inner fasteners can take any form, including ail fasteners disclosed herein. Personal flotation device 80 further comprises one or more outer fasteners 84, such as straps or belts, and an articulated section 82. Therefore, personal flotation device 80 is more tightly secured to the body of the user when worn by virtue of a combination of inner and outer fasteners, thus preventing personal flotation device 80 from "riding up" on the user.

Figure 11A:
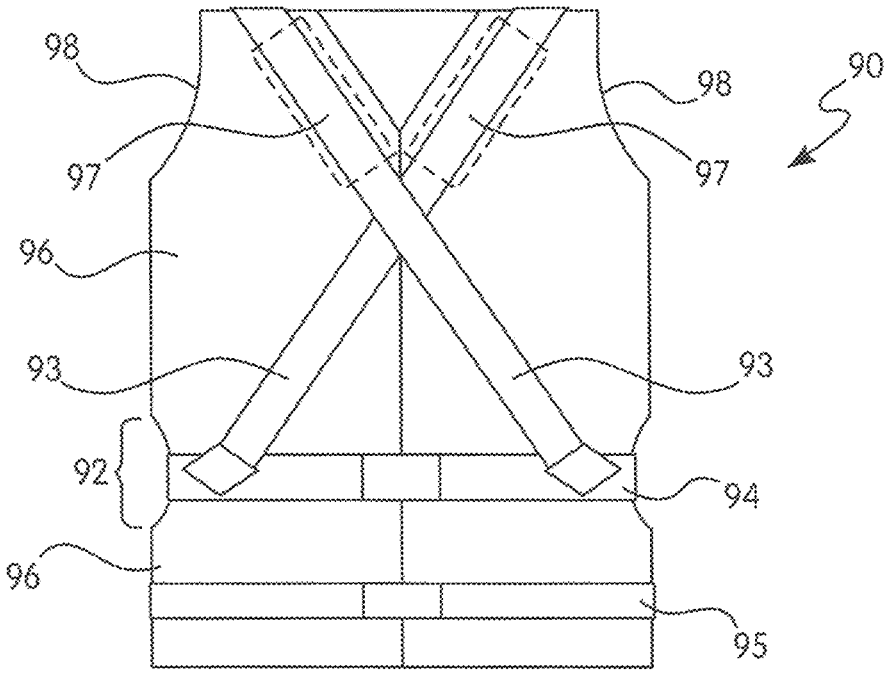
FIG. 11A is a front view of a personal flotation device in accordance with embodiments of the present invention.
Figure 11B:
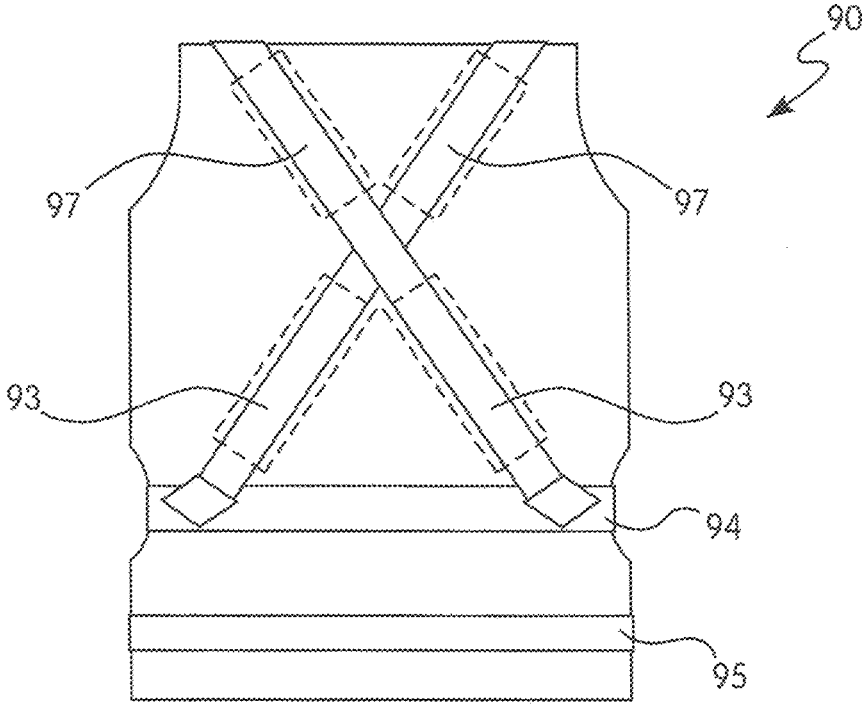
FIG. 11B is a back view of a personal flotation device in accordance with embodiments of the present invention.

Another embodiment of the personal flotation device in accordance with the present invention is shown in FIGS. 11A and 11B, wherein personal flotation device 90, in addition to life vest fastener 95, flotation padding 96, arm holes 98, and neck hole 99, comprise straps 93 located on the outer side of personal flotation device 90. The ends of straps 93 are secured to fastener 94 in articulated section 92 on the front and back outer sides of personal flotation device 90 via clasps and travel over the shoulder areas of device 90 after crossing each other over the front and back outer sides of device 90 Straps 93 are secured into position on the front and back of device 90 by travelling through channels 87 located under the front and back outer sides of device 90. Straps 93 are adjustable to reduce the amount of space between personal flotation device 90 and the shoulders of the user wearing device 90, thus, assisting in the prevention of device 90 "riding up" on the user. Personal flotation device 90 further comprises one or more outer fasteners 94, such as straps or belts, and an articulated section 92. Therefore, personal flotation device 90 is more tightly secured to the body of the user when worn by virtue of a combination of fasteners and crossing over-the-shoulder straps, thus preventing personal flotation device 90 from "riding up" on the user.

It is to be appreciated that an article of clothing comprising a corresponding fastener can be matched with a personal flotation device, e.g., a life vest, and sold as a pair. Therefore, it is to be appreciated that such a device can be sold as a kit having, e.g., a bathing suit and a life jacket Therefore, a user may create a matching bathing suit/life jacket combination that is aesthetically pleasing.

In certain embodiments, the personal flotation device according to the present invention is operated by having a user put on a life vest having, e.g., a belt and an articulated section (FIG. 3). The user then tightens the fastener, e.g., belt, around the articulated section. In another embodiment, the user may put on the personal flotation device, run the bottom fastener between their legs, and then fasten it to the front of the device (FIG. 4). Alternatively, the bottom fastener may already be fastened and, as such, the user can simply step into the leg holes and secure the personal flotation device to his or her body thereafter. In another embodiment, the user may first secure the inner belt to, his or her body and then secure the personal flotation device thereafter (FIGS. 5A and 58). In yet another embodiment. the user may first put on the article of clothing having the fastener and overlay the personal flotation device to secure the personal flotation device thereto (FIGS. 6 through 9).

The advantages of the personal flotation devices according to the present invention are readily apparent. Specifically, the personal flotation devices according to the present invention minimizes'the effects of "ride up," which increases comfort and minimizes harm and/or injury, e.g., chafing, to the user.

While the present invention has been described with reference to certain embodiments, it will be appreciated by those skilled in the art that various changes may be made and equivalents may be substituted for elements thereof without departing from the scope of this invention. For example, features described in one embodiment may be incorporated into a different embodiment, such as the, use of an inner fastener and an articulated section. Additionally, features described in one manner may instead be accomplished by known techniques in the art, such as the type of fastener, n addition, modifications may be made to adapt a particular situation or material to the teachings of the various embodiments without departing from the essential scope thereof. For example, the personal flotation devices according to the present invention may be configured to look like a bathing suit and/or match a bathing suit color. Therefore, it is to be understood that the embodiments disclosed herein not be limited to the particular aspects disclosed, but are intended to cover modifications within the spirit and scope of the embodiments of the present invention, as disclosed above.

The invention claimed is:

1. A personal flotation device comprising:

a wearable shell comprising:

an articulated section extending across a width of the wearable shell;

a first buoyant member housed by the wearable shell;

a second buoyant member housed by the wearable shell and spaced from the first buoyant member, wherein the articulated section extends between the first and second buoyant members and defines a substantially planar vertical extent therebetween; and a fastening assembly configured to fasten the wearable shell to a user's torso at one of a plurality of positions along the substantially planar vertical extent of the articulated section, wherein the fastening assembly includes a plurality of fasteners extending along the substantially planar vertical extent of the articulated section and one of the plurality of fasteners is movable between a first position defining a first circumferential length and a second position defining a second circumferential length.

2. The personal flotation device of claim 1, wherein one of the plurality of fasteners of the fastening assembly is selectively positionable along the substantially planar vertical extent of the articulated section.

3. The personal flotation device of claim 2, further comprising a plurality of hoops positioned along the substantially planar vertical extent of the articulated section, wherein each of the plurality of hoops are configured to receive one of the plurality of fasteners for positioning at one of the plurality of positions along the substantially planar vertical extent of the articulated section.

4. The personal flotation device of claim 1, further comprising:

a third buoyant member housed by the wearable shell and spaced from the first and second buoyant members, and a secondary fastener extending across a width of the wearable shell and positioned between the third buoyant member and one of the first or second buoyant members.

5. The personal flotation device of claim 1, wherein one of the plurality of fasteners is an elongated fastener having a first end and a second end connectable to the first end.

6. The personal flotation device of claim 1, wherein the articulated section is configurable to have a thickness less than a thickness of one of the first or second buoyant members.

7. The personal flotation device of claim 6, wherein the articulated section is a compressible section.

8. The personal flotation device of claim 1, wherein the articulated section completely circumscribes the wearable shell.

9. The personal flotation device of claim 1, wherein the wearable shell further comprises a passageway therein adjacent to the articulated section and is configured to receive the fastening assembly.

10. A personal flotation device comprising:

a wearable shell comprising:

an articulated section extending across a width of the wearable shell;

a passageway inside the wearable shell and adjacent to the articulated section;

a first buoyant assembly connected to the wearable shell;

a second buoyant assembly connected to the wearable shell and spaced from the first buoyant assembly, wherein the articulated section extends between the first and second buoyant assemblies and defines a substantially planar vertical extent of the articulated section therebetween;

a fastener extending along the passageway and selectively positionable along the substantially planar vertical extent of the articulated section, wherein the fastener is movable between a first position defining a first circumferential distance and a second position defining a second circumferential distance; and a plurality of fasteners extending along the substantially planar vertical extent of the articulated section.

11. The personal flotation device of claim 10, wherein the first and second buoyant assemblies each define a circumferential distance around the wearable shell greater than one of the first or second circumferential distances defined by the fastener.

12. The personal flotation device of claim 10, further comprising a plurality of hoops positioned along the substantially planar vertical extent of the articulated section, wherein each of the plurality of hoops are configured to receive one of the plurality of fasteners for positioning at one of the plurality of positions along the substantially planar vertical extent of the articulated section.

13. The personal flotation device of claim 10, further comprising:

a third buoyant member housed by the wearable shell and spaced from the first and second buoyant members, and a secondary fastener extending across a width of the wearable shell and positioned between the third buoyant member and one of the first or second buoyant members.

14. The personal flotation device of claim 10, wherein the fastener is an elongated fastener having a first end and a second end connectable to the first end.

15. The personal flotation device of claim 10, wherein the articulated section is configurable to have a thickness less than a thickness of one of the first or second buoyant members.

16. The personal flotation device of claim 15, wherein the articulated section is a compressible section.

17. The personal flotation device of claim 10, wherein the articulated section completely circumscribes the wearable shell.

* * * * *